US006160212A

United States Patent [19]

Morse

[11] Patent Number: 6,160,212

[45] Date of Patent: Dec. 12, 2000

[54] GUITAR SLIDE

[76] Inventor: Mark Morse, 635 W. Garland, Spokane, Wash. 99205

[21] Appl. No.: 09/414,920

[22] Filed: Oct. 12, 1999

[51] Int. Cl.[7] ..... G10D 3/00

[52] U.S. Cl. ..... 84/315

[58] Field of Search ..... 84/319, 315, 316, 84/317; D17/99

[56] References Cited

U.S. PATENT DOCUMENTS

| | | | |
|---|---|---|---|
| 3,638,525 | 2/1972 | Sciurba | 84/319 |
| 3,741,065 | 6/1973 | Harris | 84/319 |
| 5,151,762 | 9/1992 | Perkins et al. | 84/315 |
| 5,251,527 | 10/1993 | Pogan | 84/319 |
| 5,450,778 | 9/1995 | Roberts | 84/319 |
| 6,054,643 | 4/2000 | Chance et al. | 84/322 |

*Primary Examiner*—Jeffrey Donels
*Assistant Examiner*—Kim Lockett
*Attorney, Agent, or Firm*—David S. Thompson

[57] ABSTRACT

A guitar slide 10 includes a cylindrical body 20 defining an internal cavity 21. The cavity is defined by a very gradually tapered inner surface 25 which tends to result in a frictional connection with the musician's finger. A forward opening 30 is reduced in diameter by a neck 40 having an annular inner surface 41 with a diameter smaller than the tapered inner surface 25 of the cylindrical body. A curved transition surface 42, between the annular inner surface of the neck and the tapered inner surface 25 of the cylindrical body, tends to grip the tip of the musician's finger when the finger is gently forced toward the forward opening. A rear opening 50 is defined between a semi-circular rim 51 and a crescent-shaped rim 52, resulting in an opening which provides access to the internal cavity 21 from the direction perpendicular to the length of the cylindrical body 20. A finger rest 60 includes a flat surface 61 which is bordered by the outer surface of the cylindrical body. The finger rest allows a finger adjacent to the finger carried within the guitar slide to stabilize the guitar slide during use.

3 Claims, 1 Drawing Sheet

GUITAR SLIDE

CROSS-REFERENCES

This application is related to a co-pending design application filed simultaneously.

BACKGROUND

With the increased interest in stringed musical instruments, such as guitars, there is a corresponding increase in the need to expand the range of sounds that are generated. The generation of unique sounds not only assures that the instrument remains interesting to listeners, but also increases the variety of musical formats which may be supported by these instruments. Additionally, an artist who is more versatile, due to the increased number of sounds which can be generated, has a greater chance to achieve commercial and professional success.

As a result, a variety of picks and fingering devices have been developed to assist guitarists and other musicians in the generation of sound from stringed instruments. One such device is a guitar slide disclosed in U.S. Pat. No. 5,515,762 which allows a musician to contact one or more strings. The short length of the '762 guitar slide covers only the tip of the musician's finger; i.e. the first knuckle is not covered. Parallel and spaced apart flats, i.e. flat side surfaces defined on opposite sides of the guitar slide, tend to orient the guitar slide to result in only narrow separation between the musician's fingers.

While the above device is known, the most commonly used guitar slides are probably hollow cylindrical tubes, typically manufactured of glass, steel or brass. Such a slide is worn over the entire length of one of the musician's fingers, allowing contact between the outside surface of the slide with guitar strings. While such slides may be used to produce the desired effect, there is generally too much movement between the musician's finger and slide. Such movement results in a wobbly or insecure feeling which may require extra attention on the part of the musician, and may not result in the performance desired.

For the foregoing reasons, there is a need for an improved guitar slide having a structure that results in more secure attachment to the musician's finger. The guitar slide should provide improved ability to allow the musician's finger to bend, while still covering a substantial portion of the finger. The guitar slide should additionally provide a means to allow an adjacent finger to be used to stabilize the guitar slide in a manner which cooperates with the structures resulting in more secure attachment to the musician's finger.

SUMMARY

The present invention is directed to an apparatus that satisfies the above needs. A novel guitar slide is disclosed that (1) has a tapered inner surface and annular neck which results in more secure attachment to the musician's finger, (2) a rear opening defined by adjacent semi-circular and crescent shaped rims which result in improved ability of the musician's finger to bend, and (3) provides a finger rest to allow the use of a finger adjacent to the finger within the guitar slide to be used to stabilize the guitar slide.

The guitar slide of the present invention provides some or all of the following structures.

(A) A cylindrical body defines a cavity within which the musician's finger is placed, with the tip of the finger adjacent to the forward end of the body, and the base of the finger adjacent to the rearward end of the body. During use, an outer surface of the cylindrical body contacts the strings of the guitar, altering their vibration. A tapered inner surface tends to hold the musician's finger in a secure and generally rigid manner.

(B) In a preferred version, a forward opening is defined in the forward end of the cylindrical body.

(C) A neck is defined in a forward portion of the cylindrical body, and includes an annular surface and curved transition surface. The decreased diameter of the neck results in an increased frictional bond between the guitar slide and the musician's finger.

(D) A rear opening in the cylindrical body maximizes the mobility of the musician's finger, while also allowing the cylindrical body to cover a substantial portion of the finger, and to therefore maximize the grip of the guitar slide on the finger. The rear opening is defined between a semi-circular rim and a crescent-shaped rim, thereby resulting in a two-lobed configuration.

(E) A finger rest is defined on a portion of the outside surface of the cylindrical body, adjacent to the rearward end and opposite the crescent-shaped rim. The finger rest provides a flat surface on which the musician may rest an adjacent finger, typically the ring finger. In this manner, the guitar slide is further stabilized during operation.

It is therefore a primary advantage of the present invention to provide a novel guitar slide which provides a tapered inner surface and neck which results in more secure attachment to the musician's finger.

Another advantage of the present invention is to provide a guitar slide having a cylindrical body with a rear opening defined between a semi-circular rim and a crescent shaped rim. The shape of the rear opening results in the ability of the musician's finger to bend the second knuckle, while still enclosing the second knuckle within the tapered inside rear surface. This is in contrast to known hollow tube guitar slides, which do not provide any enclosure about a knuckle which is bent.

A still further advantage of the present invention is to provide a guitar slide which provides a finger rest to allow the use of a finger adjacent to the finger within the guitar slide to stabilize the guitar slide.

DRAWINGS

These and other features, aspects, and advantages of the present invention will become better understood with regard to the following description, appended claims, and accompanying drawings where:

DESCRIPTION

Figure 1:
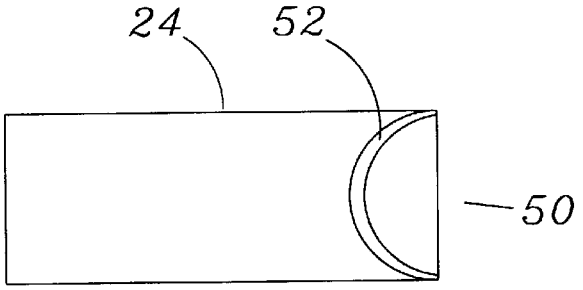
FIG. 1 is a side orthographic view of a version of the guitar slide of the invention, showing the lower side, including the crescent-shaped rim, and the portion of the rear opening defined by the crescent rim.
Figure 2:
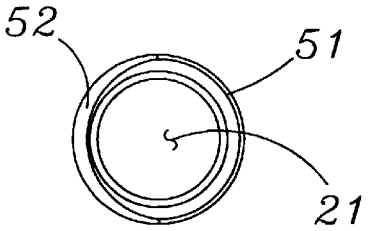
FIG. 2 is an orthographic view of the rear end of the guitar slide of FIG. 1.
Figure 3:
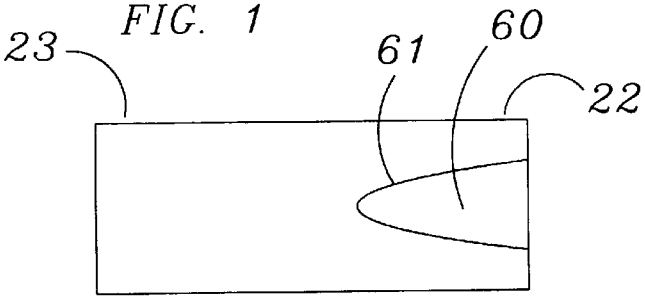
FIG. 3 is a side orthographic view of the upper side of the guitar slide of FIG. 1.

Referring in generally to FIGS. 1 through 7, a guitar slide 10 constructed in accordance with the principles of the invention is seen. The guitar slide includes a cylindrical body 20 defining an internal cavity 21. The cavity is defined by a very gradually tapered inner surface 25 which tends to result in a frictional connection with the musician's finger. A forward opening 30 is reduced in diameter by a neck 40 having an annular inner surface 41 with a diameter smaller than the tapered inner surface 25 of the cylindrical body. A curved transition surface 42, between the annular inner surface of the neck and the tapered inner surface 25 of the cylindrical body, tends to grip the tip of the musician's finger when the finger is gently forced toward the forward opening. A rear opening 50 is defined between a semi-circular rim 51 and a crescent-shaped rim 52, resulting in an opening which provides access to the internal cavity 21 from the direction perpendicular to the length of the cylindrical body 20. A finger rest 60 includes a flat surface which is bordered by the outer surface of the cylindrical body. The finger rest allows a finger adjacent to the finger carried within the guitar slide to stabilize the guitar slide during use.

Figure 6:
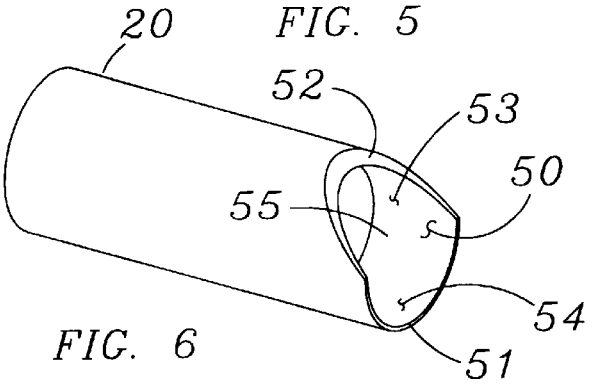
FIG. 6 is a perspective view of the rear end of the guitar slide of FIG. 1, showing the rear end opening.
Figure 7:
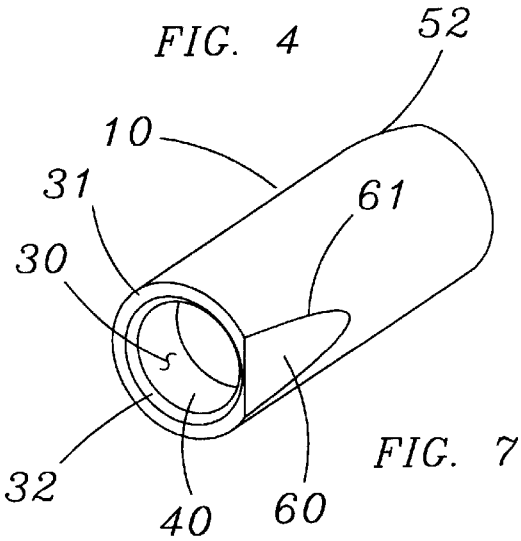
FIG. 7 is a perspective view of the guitar slide showing the forward opening and the finger rest.

Referring particularly to FIGS. 6 and 7, a cylindrical body 20 is hollow, defining a musician's finger cavity 21. When worn by the musician, the tip of the musician's finger is carried within the forward end 22 of the cylindrical body, and the base of the musician's finger is carried within the rearward end 23 of the cylindrical body. The musician's finger cavity is sized to allow the musician to fit a single finger within the cavity, and for the slide to become attached to the finger due to frictional contact between the two. Due to the differences in the size of different musician's fingers, the overall size of the guitar slide adapted for any specific user may vary somewhat.

The tapered inner surface 25 of the cylindrical body is tapered very slightly to result in a frictional grip on the musician's finger when placed within the musician's finger cavity. The tapered inner surface is slightly smaller in diameter toward the forward end 22 of the cylindrical body, and slightly larger in diameter toward the rearward end 23 of the cylindrical body. As a result, by firmly inserting one finger, the musician is assured of a firm grip on the guitar slide 10.

During use, the outer surface 24 of the cylindrical body may be used to contact the strings of the guitar in a manner similar to known guitar slides.

Figure 5:
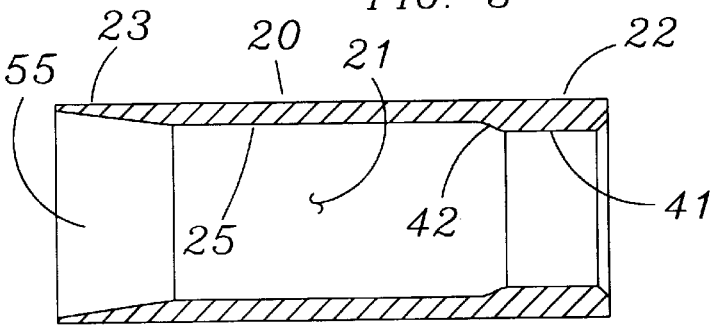
FIG. 5 is a cross-sectional view taken along the 5—5 lines of FIG. 1.

As seen in FIGS. 5 and 7, a forward opening 30 is defined by a forward end rim 31 and adjacent beveled annular surface 32. The forward end rim 31 is an annular surface in a plane perpendicular to the length of the cylindrical body. The beveled annular surface 32 is adjacent to, and radially inwardly from, the forward end rim 31.

As seen in the cross-sectional view of FIG. 5 and the perspective view of FIG. 7, a neck 40 is defined on the inside of the cylindrical body. The neck tends to narrow the musician's finger cavity 21 adjacent to the forward opening 30. As a result, when the musician inserts a finger in the cavity, the tip of the musician's finger will tend to become wedged in the area of the neck. This results in additional stability and control over the guitar slide 10 during use, resulting in easier and more convenient play.

The neck includes an annular surface 41 adjacent to the beveled annular surface 32 of the forward opening, and a curved transition surface 42 between the annular surface 41 and the tapered inner surface 25.

A rear opening 50 allows the musician to insert one finger into the finger cavity 21. The rear opening maximizes the mobility of the musician's finger, while also allowing the cylindrical body to cover a substantial portion of the finger, and to therefore maximize the grip of the guitar slide on the finger.

With the first knuckle of a finger fully enclosed within the guitar slide, the second knuckle is carried within the region bounded by the tapered inside rear surface 55. When the second knuckle is straightened, the finger extends primarily through the rearwardly directed passage 54 of the rear opening. When the second knuckle is bent at 90 degrees, the finger extends primarily through the upwardly directed passage 53 of the rear opening. As a result, the second knuckle of the finger is partially enclosed by the tapered inside rear surface 55, thereby tending to secure the guitar slide to the finger without preventing the second knuckle from bending.

The rear opening 50 is defined between a semi-circular rim 51 and a crescent-shaped rim 52, thereby resulting in a two-lobed configuration. The semi-circular rim defines the rearwardly directed passage 54 of the rear opening, while the crescent-shaped rim defines the upwardly directed passage 53 of the rear opening. Together, the rearwardly directed passage and upwardly directed passage of the rear opening allow the user to bend the second knuckle of the finger which is carried within the finger cavity 21.

A finger rest 60 is defined on a portion of the outside surface 24 of the cylindrical body 20. The finger rest allows the musician to support and stabilize the guitar slide by placing a finger on the finger rest. For example, where the second finger is inserted into the guitar slide, the ring finger may be placed on the finger rest to stabilize the guitar slide.

Figure 4:
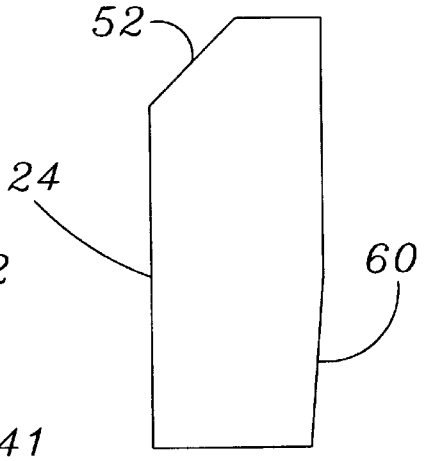
FIG. 4 is an orthographic view of the side of the guitar slide of FIG. 1.

As seen in FIGS. 4 and 7, the finger rest 60 is located on the forward end end of the cylindrical body, on the side opposite the crescent-shaped rim. The finger rest provides a flat surface on which the musician may rest a finger. In a preferred embodiment, the flat surface is separated from the outer cylindrical surface 24 by a curved edge 61.

Prior to use, the musician typically inserts the second finger of one hand into the finger cavity 21, causing the tip of the second finger to wedge into the annular surface of the neck 41 slightly, and to thereby cause sufficient friction as to maintain the guitar slide on the finger. The tip of the ring finger is then placed on the finger rest 60. As a result of contact between the second and ring fingers, the guitar slide moves as directed by finger movement, without movement resulting from slipping or sliding.

During play, the rounded cylindrical outer surface 24, generally including the surface seen in FIG. 1, is used to contact the strings of the guitar.

The previously described versions of the present invention have many advantages, including a primary advantage of providing a novel guitar slide which provides a tapered inner surface and neck which results in more secure attachment to the musician's finger.

Another advantage of the present invention is to provide a guitar slide having a cylindrical body with a rear opening defined between a semi-circular rim and a crescent shaped rim. The shape of the rear opening results in the ability of the musician's finger to bend the second knuckle, while still enclosing the second knuckle within the tapered inside rear surface. This is in contrast to known hollow tube guitar slides, which do not provide any enclosure about a knuckle which is bent.

A still further advantage of the present invention is to provide a guitar slide which provides a finger rest to allow the use of a finger adjacent to the finger within the guitar slide to stabilize the guitar slide.

Although the present invention has been described in considerable detail and with reference to certain preferred versions, other versions are possible. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A guitar slide adapted to be worn on a musician's finger, the guitar slide comprising:

(A) a cylindrical body defining a musician's finger cavity, the cylindrical body having tapered inner surface means for holding a musician's finger;

(B) a forward opening defined in a forward end of the cylindrical body; and (C) a neck defined in a forward portion of the cylindrical body, the neck having an annular surface having an inside diameter of less than an inside diameter of the tapered inner surface; and (D) a finger rest, defining a flat surface on a portion of the outside surface of the cylindrical body adjacent to the forward end of the cylindrical body and opposite a crescent-shaped rim partially defining a rear opening of the cylindrical body.

2. A guitar slide adapted to be worn on a musician's finger, the guitar slide comprising:

(A) a cylindrical body defining a musician's finger cavity, the cylindrical body having tapered inner surface means for holding a musician's finger;

(B) a forward opening defined in a forward end of the cylindrical body; and (C) a neck defined in a forward portion of the cylindrical body, the neck having an annular surface having an inside diameter of less than an inside diameter of the tapered inner surface; and (D) a rear opening in the cylindrical body defined between a semi-circular rim and a crescent-shaped rim, thereby resulting in a two-lobed configuration.

3. A guitar slide adapted to be worn on a musician's finger, the guitar slide comprising:

(A) a cylindrical body defining a musician's finger cavity, the cylindrical body having tapered inner surface means for holding a musician's finger;

(B) a forward opening defined in a forward end of the cylindrical body;

(C) a neck defined in a forward portion of the cylindrical body, the neck having an annular surface having an inside diameter of less than an inside diameter of the tapered inner surface, and having a curved transition surface;

(D) a rear opening in the cylindrical body defined between a semi-circular rim and a crescent-shaped rim, thereby resulting in a two-lobed configuration; and (E) a finger rest, defined on a portion of the outside surface of the cylindrical body adjacent to the rearward end and opposite the crescent-shaped rim, the finger rest providing a flat surface.

* * * * *